US006003722A

United States Patent [19]

Thurner

[11] Patent Number: 6,003,722

[45] Date of Patent: Dec. 21, 1999

[54] FILTER DISPENSER

[75] Inventor: Peter Thurner, Göttingen, Germany

[73] Assignee: Sartorius AG, Germany

[21] Appl. No.: 08/970,278

[22] Filed: Nov. 14, 1997

[30] Foreign Application Priority Data

Nov. 14, 1997 [DE] Germany ..... 196 47 319

[51] Int. Cl.[6] ..... G07F 11/66

[52] U.S. Cl. ..... 221/25; 221/71; 221/72

[58] Field of Search ..... 221/25, 71, 72, 221/73

[56] References Cited

U.S. PATENT DOCUMENTS

| | | | |
|---|---|---|---|
| 3,341,066 | 9/1967 | Bowes | 221/25 |
| 4,993,586 | 2/1991 | Taulbee et al. | 221/25 |
| 5,065,894 | 11/1991 | Garland | 221/72 X |
| 5,605,944 | 2/1997 | Heebner | 523/404 X |
| 5,639,815 | 6/1997 | Cochran et al. | 524/413 X |

*Primary Examiner*—William E. Terrell
*Assistant Examiner*—Gene O. Crawford
*Attorney, Agent, or Firm*—Chernoff, Vilhauer McClung & Stenzel, LLP

[57] ABSTRACT

A filter dispenser for the storage and dispensation of individual flat filter sections. The filter dispenser includes a storage compartment with a slot shaped exit for a tube-like band, composed of two parts, and guides in proximity to the slot for the running through of the band parts. The two parts of the band are joined by continuous and releasable edges and cross connections which form pockets which seat filter sections. Upon simultaneous drawing of the parts of the band through the guides, the connections of the band between the guides and the storage compartment are broken and the encapsulated filter sections are released for removal.

7 Claims, 2 Drawing Sheets

FILTER DISPENSER

Figure 1:
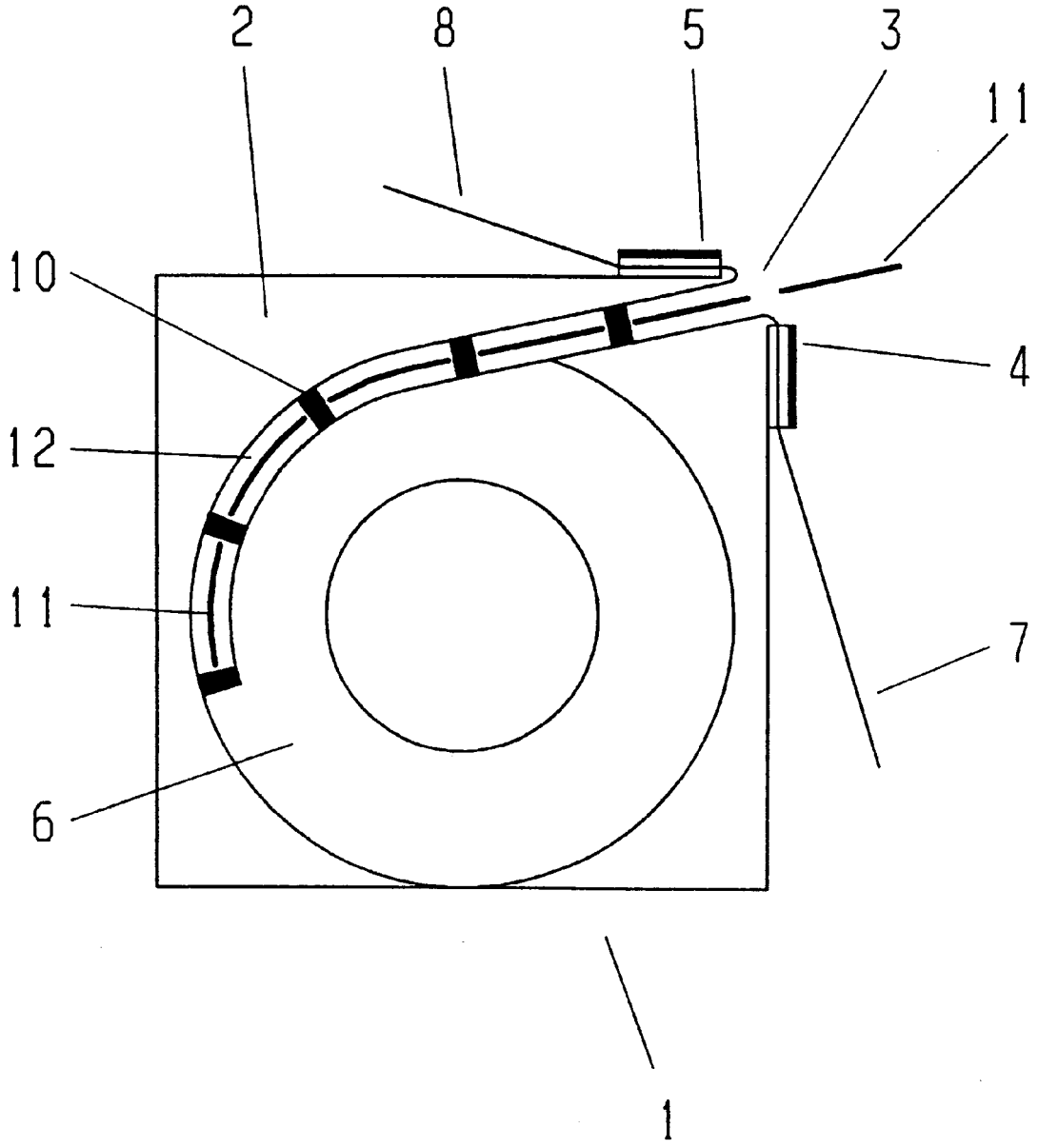

The invention is concerned with a filter dispenser for the reception and release of single, flat filter sections, which are stored in quantity in a filter dispenser.

Filter dispensers find their application in biotechnical laboratories, medicine and pharmaceutical manufacture, in the food and drink industry and in environmental activities. The said dispensers are especially valuable for filtration applications under sterile conditions, such as are found in microbiology and analytical work.

Filter dispensers are of common knowledge. The DE-OS 31 28 547 A1 describes a filter dispenser for sterilized, flatly extended, disposable material and the like, applicable in medical and laboratory fields. This dispenser is characterized by a storage space for the reception of a spiral shaped, rolled up or accordion pleated band formed in tube fashion out of two pieces. Further, in its interior, this dispenser subdivides the disposable materials, which includes filter sections or nutrient plates. The exit of the storage space has at least one opening of width which is sized to pass the band with the enclosed disposable material. On both sides of the exit, pairs of transport rolls are arranged, which grasp respectively each of the two opposed parts of the band. The rolls are synchronously driven for ease of separation and for opening the two opposed parts of the tube shaped band, so that the two parts of the band, in their longitudinal and cross connection points, are separated one from the other and the disposable material is released from the encapsulating membrane and becomes removable.

In the EP 0 585 145 B1, a filter dispenser is disclosed, by which the two parts of an analogous, tube-like band are rolled up, for separation and release of the filter section by two rolls, which are driven differently in their step action and rotational velocity by a third roll for control and regulating means. These filter dispensers are disadvantageous because of the great number of components out of which the filter dispenser is comprised and the inconvenient arrangement which makes the installation of a new tube-like band difficult for the operator.

Thus the purpose of the invention lies therein, in the creation of a filter dispenser which is of easy maintenance, is comprised of fewer and less expensive components as compared to filter dispensers of the present state of the technology.

This purpose will be achieved by means of a filter dispenser, which is comprised of a storage compartment with a slot shaped exit opening for a tube-like band and having guides adjacent thereto through which said band parts are directed.

The tube-like band is constructed of two parts, which are connected together by means of continuous, side and cross connections which are releasable under tension and serve to form pockets, in which the filter sections are found. One end of the band disposed in the storage compartment is guided out through the slot shaped storage exit and opened in its upper and lower band portions. The band parts are run through the neighboring guides of the storage compartment exit in such a way, that upon the simultaneous passing of the band parts through the said guides, the connections of the band in the area between the guides and the storage compartment exit are broken and the encapsulated, flat filter section is released for removal. Since the slot shaped exit possesses an opening width equal to the distance between the width of the band in the area of the pockets filled with filter sections plus a tolerance of ca. 1 cm, this being, preferably, the breadth of the cross connection between the band parts, it is assured that upon the passing of the band parts through the guides, the band is only opened in that part which is found outside of the storage compartment, that is, above the slot shaped exit opening of the storage compartment. Since this condition is recognizable, the opening of the band and the release of the filter section for removal requires no further auxiliaries, such as step motors or sensors or the like. In the simplest case, the band parts can be manually pulled as far as necessary out from the guides to the point where the filter section can be removed. The band which is underneath the slot shaped storage exit remains closed.

The storage compartment may be, for instance, a folding box type with a hinged cover lid in the side surfaces or with slot shaped exits in the narrower edges. The guides can be made of the same material and are firmly affixed to the storage compartment, for instance, held by adhesives. It is advantageous if they coincide with the slot edges.

In one embodiment, a rotatable roll is found near one of the guides for the winding up of one of the opened band parts, whereby, during the winding up, and upon synchronous manual pulling of the other band part through a second guide, a tension is brought about on the band to the effect that the connections of the band in the area between the guides and the storage compartment exit are broken and the encapsulated flat filter sections are released for removal.

In yet another embodiment, following each guide is a rotatable roll for winding up the opened band parts, whereby, during the winding up, by means of tension, the connections of the band in the area between the guides and the storage compartment are broken, and the encapsulated, flat filter section is released for removal. It is to advantage, if the two rolls are in opposite rotation to one another and are synchronously turnable.

The tube shaped band, which is comprised of two parts joined together, can be made out of any of the band materials known to the expert, which are so bonded together, that the connections can be broken from one another under tension. These materials could, for example, be of medicinal paper. Advantageously, at least one part of the band is comprised of a film of an organic polymer. Preferred is a film which is composed of polycarbonate and, by means of supersonic welding or thermal sealing, unites with the other part. For many of the uses of the filter dispenser the bands are so made, that the flat filter sections are sterile in the pockets. So that a large number of filter sections can be stored in the compartment of the filter dispenser, it is to the purpose that the spiral band is rolled up in spiral form or pleated accordion-wise. In one embodiment, the storage compartment is planned to accept several tube-like bands, whereby, for each band an exit is provided, each with a width appropriate to the specific band which is to pass through. This is practical, when filter sections of different sizes are being employed, or in such cases as when different filter types are in question. This latter would include porous filters for the collection of microorganisms and sterile nutrient plates which are used for the incubation of the said microorganisms.

Figure 2:
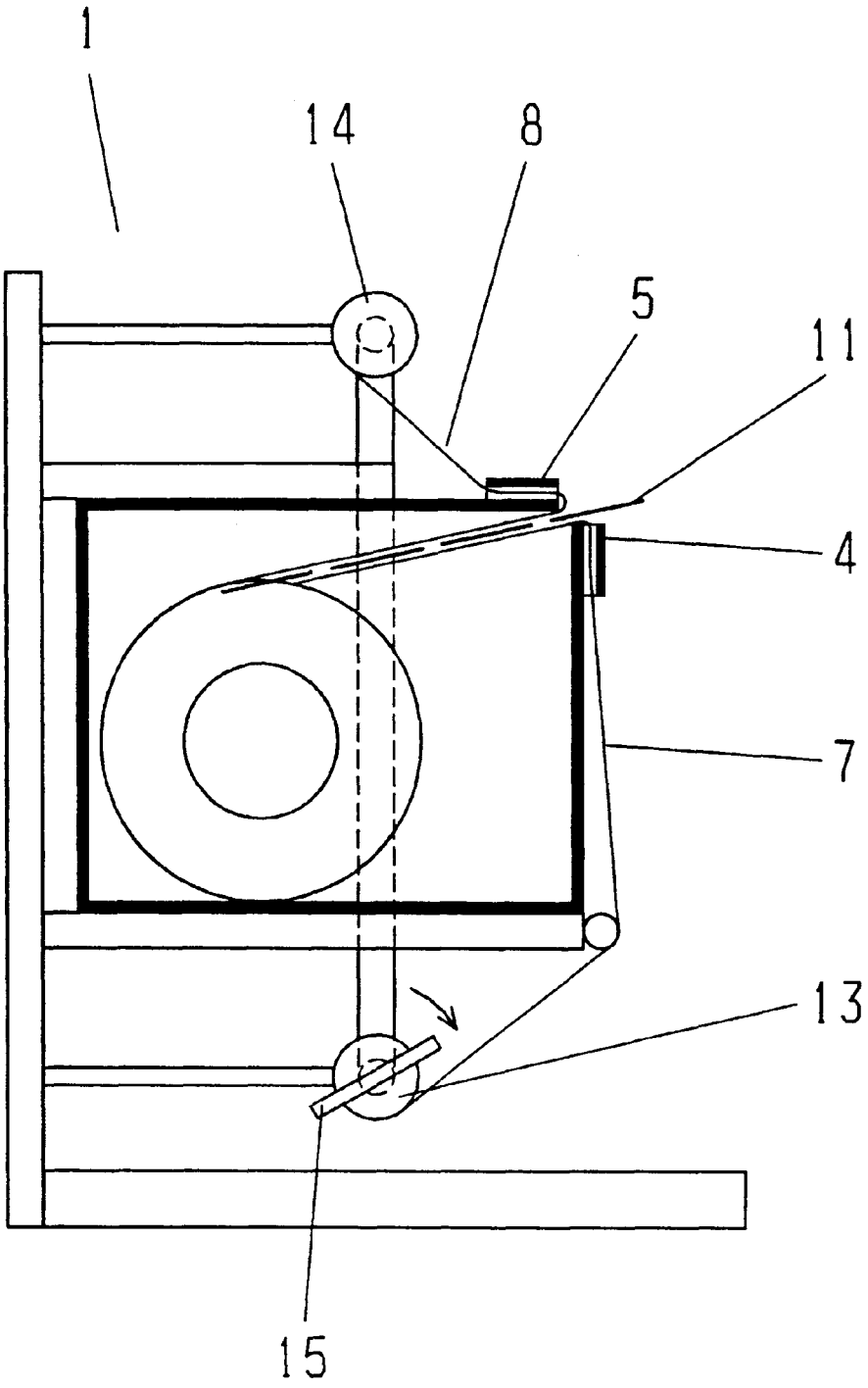

The invention is more closely described with the help of the attached FIGS. 1 and 2; There is shown by:

FIG. 1 a section through a filter dispenser in accord with the invention and FIG. 2 a section through an additional embodiment of the invention.

In accord with FIG. 1, the filter dispenser 1 is comprised of a storage compartment 2 in the shape of a folding box. The storage compartment 2 possesses a slot shaped exit 3, which finds itself in the edge of the said folding box. Neighboring the slot shaped exit 3 are found a first guide plate 4 and a second guide plate 5, which terminate at the edges of the exit slot 3. The storage compartment accepts a tube-like band 6, which is comprised of two parts, 7 and 8 joined together by edge connections 9 and cross connections 10 which are releasable under tension, and which connections form pockets in said band for the filter sections 11. The under part 7 of the band 6 which, for example is comprised of medicinal paper, runs through the guide plate 4 and the upper part 8 of the band 6, which for example, is comprised of a polycarbonate membrane, is led through guide plate 5. For the release of the flat filter sections 11, the ends of the separated parts 7 and 8 of the band 6 were seized, and as far as possible simultaneously and equally pulled through the guide plates 5, 7. In doing this, the longitudinal edge 9 connections and cross connections 10 of the band 6 were broken upon passage through the slot shaped storage compartment exit 3, in the area of the guide plates 4 and 5 and the storage compartment exit 3. When these connections were broken, the therein encapsulated filter section 11 was freed for removal.

The embodiment shown in FIG. 2 shows a filter dispenser 1, in which following the guide plates 4 and 5 were each assigned a rotatable roll 13, 14 respectively, for the winding up of the opened band parts 7 and 8. In this, the roll 13 is equipped with a handle 15 for manual rotation. By means of a transmission, the roll 14 is connected to the roll 13. Upon turning the roll 13 in the direction indicated by the arrow, then the opened ends 7 and 8 are wound up, whereby the encapsulated filter section 11 is released for removal.

What is claimed is:

1. A device for the storage and dispensation of discrete sections of media selected from filter media and culture media, wherein said media is disposed within opposing strips of protective material that are releasably bonded at their longitudinal peripheries, said device comprising:

(a) a substantially cubical housing having at least one slot along an upper edge thereof, said slot adapted to accommodate said opposing strips of protective material; and (b) at least one pair of guides on opposite sides of and adjacent to each of said at least one slot, each of said guides being so situated on said housing and adapted as to accommodate one of said opposing strips of protective material at an angle that is greater than 90° but less than 180° relative to said discrete sections of media as they are fed through said at least one slot.

2. The device of claim 1, including means for storage of unused media.

3. The device of claim 1, wherein said opposing strips of protective material are releasably bonded at latitudinal increments so as to form a multiplicity of pockets to contain discrete sections of said media.

4. The device of claim 1 wherein said media is sterile prior to its use.

5. The device of claim 1 wherein said opposing strips of protective material are stored in a configuration selected from a spiral-wound roll and a pleated stack.

6. The device of claim 1, including a reel associated with each of said guides, said reel adapted to create tension upon and to take up one of said opposing strips of protective material.

7. The device of claim 6, having two of said reels operatively connected to each other so as to rotate in synchronism.

* * * * *